US005897044A

United States Patent [19]

Deschenes et al.

[11] Patent Number: 5,897,044

[45] Date of Patent: Apr. 27, 1999

[54] NEEDLES USEFUL IN THE DISPENSING OF PLASTIC FASTENERS

[75] Inventors: Charles L. Deschenes, N. Attleboro, Mass.; William J. Cooper, Woonsocket, R.I.

[73] Assignee: Avery Dennison Corporation, Pasadena, Calif.

[21] Appl. No.: 08/377,295

[22] Filed: Jan. 24, 1995

Related U.S. Application Data

[63] Continuation of application No. 08/131,098, Oct. 1, 1993, abandoned.

[51] Int. Cl.[6] ..... B65C 7/00; A41H 37/00

[52] U.S. Cl. ..... 227/67; 112/104; 223/104

[58] Field of Search ..... 227/67; 112/98, 112/104, 222; 223/104

[56] References Cited

U.S. PATENT DOCUMENTS

| | | | |
|---|---|---|---|
| 3,416,713 | 12/1968 | Stephens | 223/104 |
| 3,470,834 | 10/1969 | Bone | 223/104 X |
| 3,872,806 | 3/1975 | Bone | 227/67 X |
| 4,306,510 | 12/1981 | O'Brien | 223/104 X |
| 4,333,596 | 6/1982 | Kunreuther | 227/67 |
| 4,533,076 | 8/1985 | Bourgue | 227/67 |
| 4,535,926 | 8/1985 | Furutsu | 227/67 |
| 4,611,740 | 9/1986 | Kunreuther | 227/67 |

*Primary Examiner*—Rinaldi I. Rada
*Assistant Examiner*—Boyer Ashley
*Attorney, Agent, or Firm*—Kriegsman & Kriegsman

[57] ABSTRACT

A needle useful in the dispensing of plastic fasteners. In one embodiment, the needle includes a shank portion and a base portion, the shank portion having a front section shaped to define a spoon-shaped tip. The tip has a blunt point with a radius approximately twice that of conventional needles. The distance from the point to where the tip reaches full diameter is approximately 80% of the distance typically found in conventional needles, and the full diameter of the tip is less than that in conventional needles. The side profile of the top edges of the tip are flat or downwardly-curved as opposed to being upwardly-curved in conventional needles. The distance across the tip at its widest point between opposing top edges is less than that in conventional needles.

8 Claims, 3 Drawing Sheets

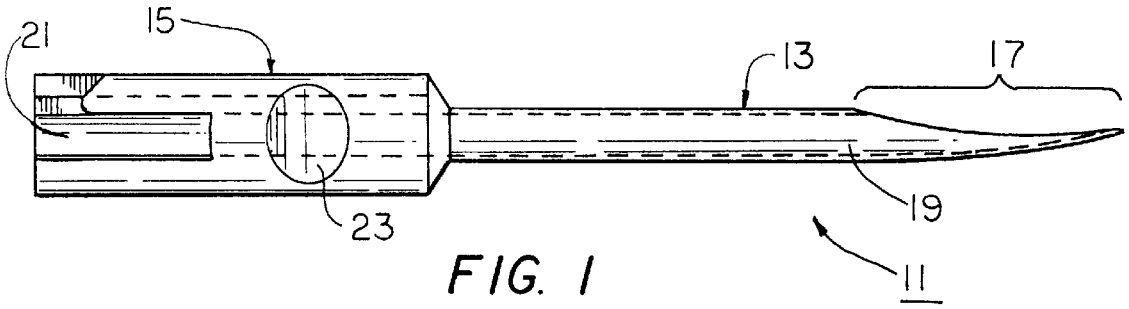
FIG. 1
PRIOR ART
FIG. 2(a)
PRIOR ART
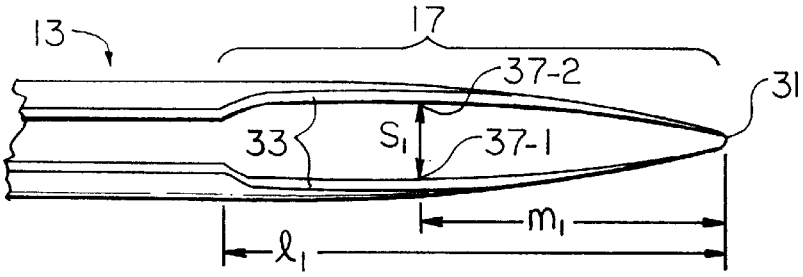
FIG. 2(b)
PRIOR ART
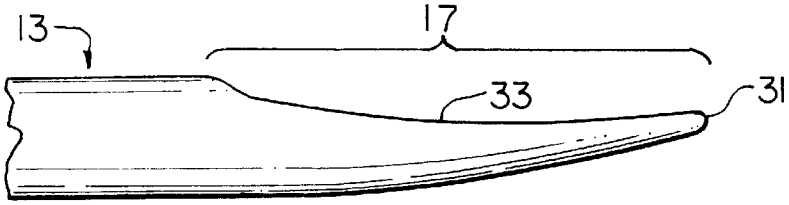
FIG. 2(c)
PRIOR ART
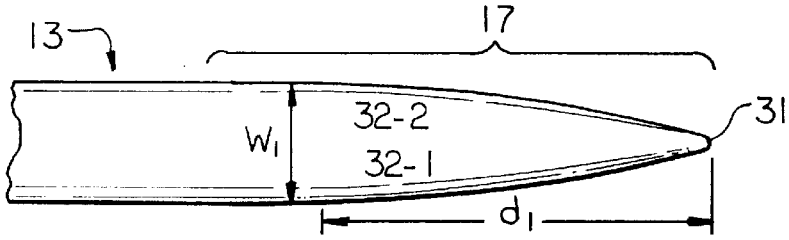
FIG. 3
PRIOR ART
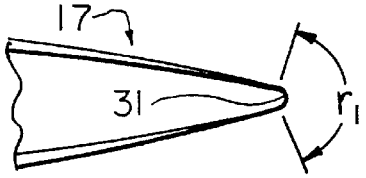

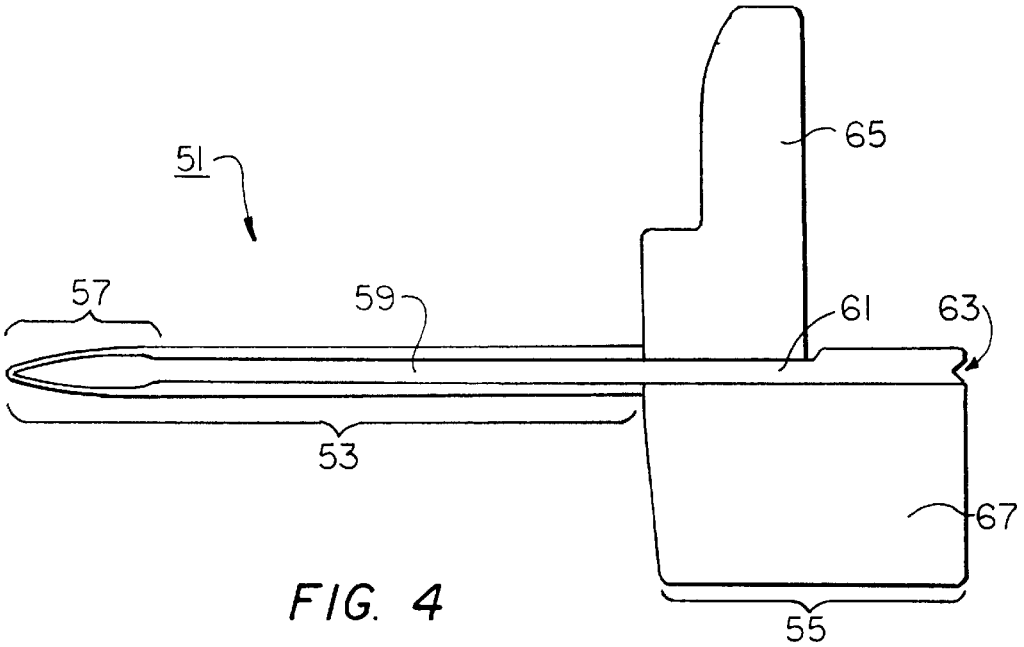
FIG. 4
FIG. 5(a)
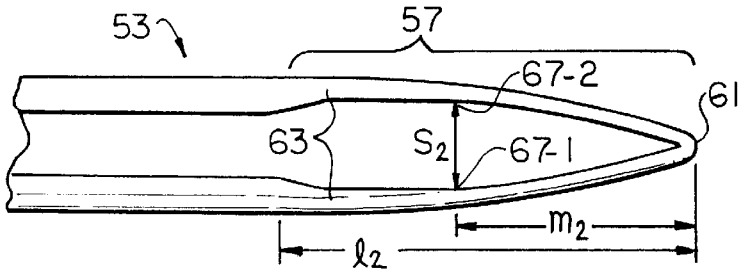
FIG. 5(b)
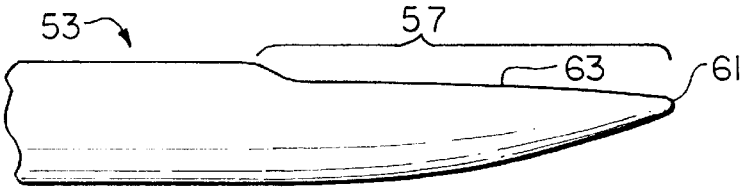
FIG. 5(c)
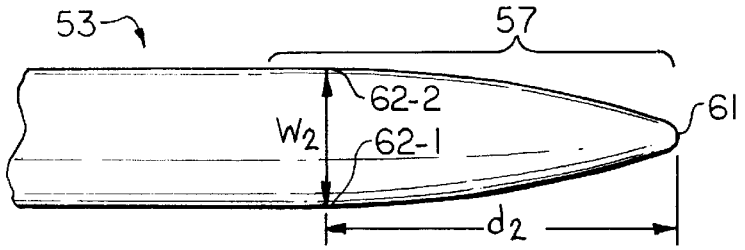
FIG. 6
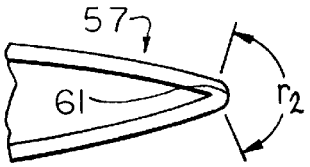

NEEDLES USEFUL IN THE DISPENSING OF PLASTIC FASTENERS

This is a continuation of application Ser. No. 08/131,098 filed on Oct. 1, 1993, now abandoned.

BACKGROUND OF THE INVENTION

The present invention is directed generally to needles useful in the dispensing of plastic fasteners and more particularly to a new and novel such needle.

Plastic fasteners of the type used to attach, for example, merchandising tags to articles of commerce are well-known in the art, as illustrated by the following commonly assigned patents: U.S. Pat. No. 3,103,666, issued Sep. 17, 1963; U.S. Pat. No. 4,121,487, Oct. 24, 1978; U.S. Pat. No. 4,456,161, issued Jun. 26, 1984; and U.S. Pat. No. 4,955,475, issued Sep. 11, 1990.

In many instances, the aforementioned plastic fasteners are fabricated in the form of continuously connected fastener stock, the fastener stock comprising a pair of elongated side members interconnected by a plurality of cross-links or filaments. Frequently, one side member comprises a plurality of T-bars joined together by severable connectors, and the other side member comprises a plurality of T-bars or paddles also joined together by severable connectors. Individual fasteners are usually dispensed from the fastener stock with the aid of a dispensing tool. Such dispensing tools typically include a needle through which the T-bar of a severed fastener is ejected into a desired article.

Such needles typically include a shank portion and a base portion, the base portion extending rearwardly from the shank portion. The shank portion typically includes a substantially cylindrical rear portion and a relatively sharp front tip for permitting penetration of a desired article. The shank portion is hollow to permit the T-bar end of a fastener to pass therethrough and has a longitudinal slot to permit the filament of the fastener to extend therefrom as the T-bar end moves through the shank portion. The base portion is typically substantially cylindrical in shape and has a central bore with an inner diameter equal to the inner diameter of the hollow shank. The base also has a longitudinal slot aligned with the slot in the shank. In needles which are removable from the dispensing tool, the base is provided with means for correctly positioning the needle within the tool and means for locking same into place. The shank portion and the base portion may form a unitary structure or may be separately formed pieces joined together.

One problem frequently encountered by using a needle of the type described above to attach a tag or the like to a garment is that the insertion of the needle through the garment often creates a hole in the garment caused, in part, by the destruction of threads in the garment which come into contact with the needle tip as it passes through the garment. This tends to lead to a larger than desired hole in the garment and makes the hole more susceptible to enlargement during the ordinary course of use of the garment. One approach to this problem has been to make the shank portion of the needle smaller in diameter and to provide the tip of the needle with a very sharp point which is small enough to be inserted between the threads of the garment being penetrated. Such needles, however, tend to break more easily than do needles of greater size and less sharp points.

SUMMARY OF THE INVENTION

It is an object of the present invention to provide a new and novel needle adapted for use in the dispensing of plastic fasteners.

It is another object of the present invention to provide a needle as described above which, when inserted through a garment, creates a smaller hole in the garment and causes less damage to the threads of the garment than does a conventional needle of similar overall size.

It is still another object of the present invention to provide a needle as described above which is of comparable strength and durability to conventional needles of similar overall size.

Additional objects of the invention, as well as features and advantages thereof, will be set forth in part in the description which follows, and in part will be obvious from the description or may be learned by practice of the invention. The objects of the invention also may be realized and attained by means of instrumentalities and combinations particularly pointed out in the appended claims.

BRIEF DESCRIPTION OF THE DRAWINGS

The accompanying drawings, which are hereby incorporated into and constitute a part of this specification, illustrate the preferred embodiments of the invention and, together with the description, serve to explain the principles of the invention. In the drawings wherein like reference numerals represent like parts:

FIG. 1 is a left side view of a conventional prior art needle useful in the dispensing of plastic fasteners;

FIGS. 2(*a*) through 2(*c*) are enlarged fragmentary top, left side, and bottom views, respectively, of the shank portion of the conventional prior art needle shown in FIG. 1;

FIG. 3 is an enlarged fragmentary top view of the tip shown in FIG. 2(*a*);

FIG. 4 is a top view of a needle useful in the dispensing of plastic fasteners, the needle being constructed according to the teachings of the present invention;

FIGS. 5(*a*) through 5(*c*) are enlarged fragmentary top, left side, and bottom views, respectively, of the shank portion of the needle shown in FIG. 4;

FIG. 6 is an enlarged fragmentary top view of the tip shown in FIG. 5(*a*);

DETAILED DESCRIPTION OF PREFERRED EMBODIMENTS

Figure 7:
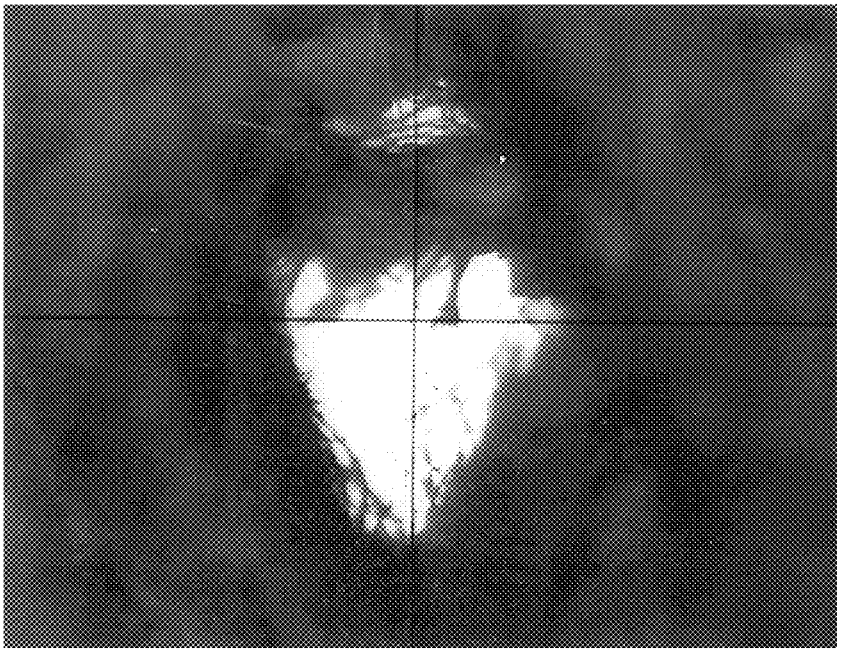
FIG. 7 is a micrograph illustrating the size and shape of a hole made in a piece of fabric by the needle of FIG. 1.

Referring now to FIG. 1, there is shown a left side view of a conventional prior art needle adapted for use in the dispensing of plastic fasteners, the needle being represented by reference numeral 11. Needle 11 may be, for example, a MARK II™ STANDARD SWIFTACHER® Needle (Model No. 08941) sold by Avery Dennison Corporation, Fastener Division (Framingham, Mass.).

Needle 11 comprises a shank portion 13 and a base portion 15. Shank portion 13, which is made from stamped and rolled metal, includes a rear section which is elongated and cylindrical over most of its length and a front section which is shaped in the form of a relatively sharp tip 17 to permit penetration of a desired article. Shank portion 13 is hollow to permit the T-bar of a fastener to pass therethrough and includes a longitudinal slot 19 (see FIG. 2(*a*)) to permit the associated filament of a fastener to extend therethrough as the T-bar moves along.

Base portion 15, which may be a conventional base portion, is made in the conventional manner by insertmolding plastic onto the rear end of shank portion 13. Base portion 15 is hollow and generally cylindrical in shape and includes a longitudinal slot 21 aligned with longitudinal slot 19 of shank portion 13. Base portion 15 is provided with means 23 for correctly positioning needle 11 within a fastener dispensing tool and for locking same into place.

Referring now to FIGS. 2(*a*) through 2(*c*), there are shown enlarged fragmentary top, left side and bottom views, respectively, of shank portion 13 for the purpose of more clearly illustrating the size and shape of shank portion 13 in general and tip 17 in particular. Where specific measurements of tip 17 are identified, they are made in reference to a MARK II™ STANDARD SWIFTACHERO Needle® (Model No. 08941).

As can be seen, tip 17 is spoon-shaped and comes to a very sharp point 31, the radius $r_1$ of point 31 being approximately 0.0035 inches (see FIG. 3). Tip 17 slowly broadens from point 31 to its full diameter $w_1$ of 0.0768 inches at points 32-1 and 32-2, the distance $d_1$ from the extremity of point 31 to either point 32-1 or point 32-2 being 0.179 inches (see FIG. 2(*c*)). The top edge 33 of tip 17 (see FIG. 2(*b*)) dips towards the bottom of tip 17 and has a generally concave-up shape. The greatest distance $s_1$ separating opposing sides of top edge 33 occurs between points 37-1 and 37-2 and is 0.062 inches (see FIG. 2(*a*)). The overall length $l_1$ of tip 17 is 0.3307 inches, and the distance $m_1$ from the extremity of point 31 to either point 37-1 or point 37-2 is 0.1460 inches.

It may be noted that, based on the above information, the ratio of length $l_1$ to diameter $w_1$ is approximately 4.3:1 and the ratio of distance $m_1$ to distance $s_1$ is approximately 2.3:1 for tip 17.

Referring now to FIG. 4, there is shown a top view of one embodiment of a needle useful in the dispensing of plastic fasteners constructed according to the teachings of the present invention, the needle being represented generally by reference numeral 51. Those portions of needle 51 not pertinent to the invention are not discussed and/or shown herein.

Needle 51 comprises a shank portion 53 and a base portion 55. Although shank portion 53 and base portion 55 are shown in the present embodiment as forming a unitary structure, preferably stamped and rolled from a sheet of metal, base portion 55 could be fabricated separately from shank portion 53, e.g., as a conventional plastic base portion insert-molded over the rear end of shank portion 53. Information concerning the manufacture of shank portion 53 and base portion 55 as a unitary structure as shown may be found in commonly assigned, presently pending U.S. patent application Ser. Nos. 07/950,420, filed Sep. 23, 1992, and 07/950,877, filed Sep. 23, 1992, both of which are incorporated herein by reference.

As can be seen, shank portion 53 includes a rear section which is elongated and cylindrical over most of its length and a front section which is shaped in the form of a relatively sharp tip 57 to permit penetration of a desired article. Shank portion 53 is hollow to permit the T-bar of a fastener to pass therethrough and includes a longitudinal slot 59 to permit the associated filament of a fastener to extend therethrough as the T-bar moves along.

Base portion 55 includes a longitudinal slot 61 aligned with longitudinal slot 59 of shank portion 53. The rear end of base portion 55 is shaped to form a knife edge 63. Base portion 55 also includes a pair of tabs 65 and 67, tab 65 being as a spring tab for securing base portion 55 within an opening in a fastener dispensing tool and tab 67 being a registration element for properly aligning base portion 55 within said opening.

Referring now to FIGS. 5(*a*) through 5(*c*), enlarged fragmentary top, left side and bottom views, respectively, of shank portion 53 are shown for purposes of comparing the size and shape of tip 57 to that of tip 17 of needle 11. As will hereinafter be described, because of its size and shape, tip 57 makes a smaller hole in a piece of fabric and causes less damage to the threads of the fabric than does tip 17.

Tip 57, like tip 17, is spoon-shaped; however, the size and shape of tip 57 varies considerably from that of tip 17 as follows: First, instead of coming to a very sharp point like point 31 of needle 11, tip 57 has a more blunt point 61 (see FIG. 6), the radius $r_2$ of point 61 being approximately 0.007 inches (which is approximately twice that of tip 17). Second, instead of slowly broadening from point 61 to its full diameter $w_2$ of 0.0693 inches at points 62-1 and 62-2, tip 57 rapidly broadens to its full diameter over a distance $d_2$ of 0.148 inches (as opposed to 0.179 inches for tip 17). Third, the top edge 63 of tip 57 (see FIG. 5(*b*)) is flat or curved downwardly as opposed to being curved upwardly as is top edge 33 of tip 17. This novel shape of tip 57 provides a reinforced structure inherently more rigid along the axis of the needle than is present in tip 17 and increases column strength. Fourth, the greatest distance $s_2$ separating opposing sides of top edge 63 is 0.047 inches, which occurs between points 67-1 and 67-2 (see FIG. 2(*a*)) and is less than the 0.062 inch distance separating the top edges of tip 17. Fifth, the overall length $l_2$ of tip 57 is 0.2252 inches (as opposed to 0.3307 inches for tip 17), and the distance $m_2$ from the extremity of point 61 to either point 67-1 or point 67-2 is 0.1123 inches (as opposed to 0.1460 inches for tip 17).

Accordingly, the ratio of length $l_2$ to diameter $w_2$ for tip 57 is approximately 3.2:1 (as compared to 4.3:1 for tip 17), and the ratio of distance $m_2$ to distance $s_2$ for tip 57 is approximately 2.4:1 (as compared to 2.3:1 for tip 17).

Figure 8:
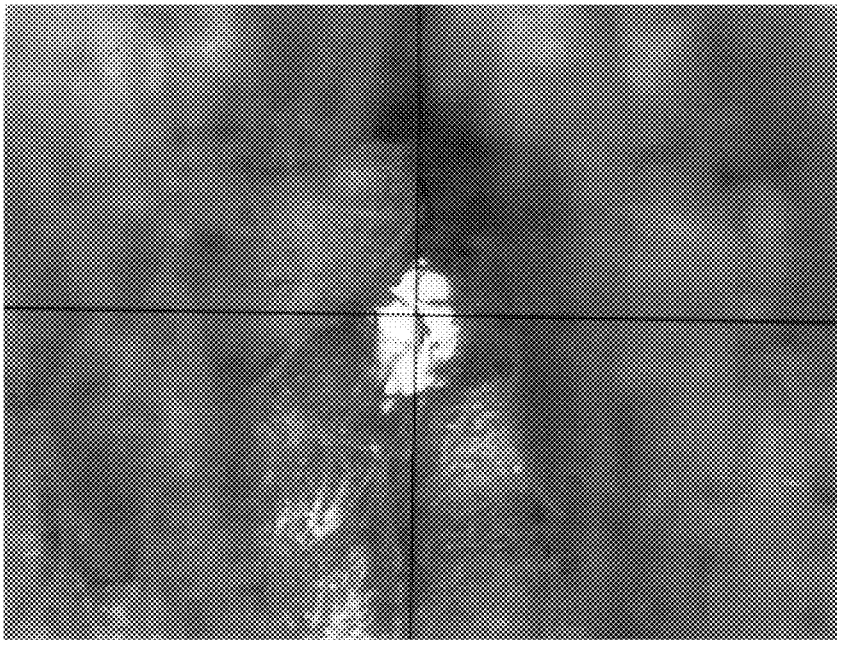
FIG. 8 is a micrograph illustrating the size and shape of a hole made in a piece of fabric by the needle of FIG. 4.

Referring now to FIGS. 7 and 8, there are shown micrographs of two pieces of fabric through which needles 11 and 51, respectively, were inserted. As can be seen, the hole that was created by needle 11 is bigger and less uniform in shape than the hole created by needle 51 (0.0365 inches×0.0578 inches as compared to 0.0250 inches×0.0126 inches). Although not intending to predicate the invention on any particular theory, it is believed that needle 51 creates a smaller, less damaging hole than needle 11 for the reasons set forth below:

Conventional theory suggests that a needle must have a very sharp point, sharp enough to negotiate a path between the threads of the woven material being penetrated. This theory leads to the conclusion that the radius of the point must be smaller than the space between threads and that the profile of the point must build very gradually in size to the full diameter of the needle. It is believed by the present inventors, however, that the very gradually increasing profile actually acts like a knife as it slides past the threads during penetration. Furthermore, the very sharp point tends to catch on the fibers of the respective threads when by chance the needle is inserted on or nearly on center with a given thread. The result is a cut or partially cut thread, a distorted hole worsened by the knife action of the gradually increasing profile, and a geometrically weak point design.

By contrast, the needle of the present invention utilizes a more blunt point profile and a more rapid diameter increase to counteract the above-described phenomena. The blunt point tends to displace the threads one from the other while minimizing the action of the thread fibers catching onto the point. The rapid diameter increase moves the cutting effect of the profile progressively away from the fibers, thereby reducing the slicing time on any one fiber at any given elevation along the axis of a given fiber. This is accomplished by virtue of the rapid development of the hole diameter within a much shorter distance from the point than conventional needles.

It should be understood that, although specific dimensions have been discussed above in reference to needle 51, the present invention is not to be limited to needles of the size of needle 51 and that, at the very least, the present invention contemplates the inclusion of needles having tips proportionately greater or lesser in size than tip 57, with the same general shape as tip 57.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A needle for use in a tool for dispensing plastic fasteners, the plastic fasteners each comprising an elongated filament and a cross-bar, the cross-bar being disposed at one end of the elongated filament, said needle comprising:

a) a shank portion, said shank portion having a cylindrical body terminating in a cone-shaped tip having a blunt point, said blunt point having a radius of approximately 0.007 inches, said cylindrical body being provided with a longitudinal bore through which the cross-bar of a fastener may pass and a slot through which the elongated filament of a plastic fastener may extend, said slot extending longitudinally along said cylindrical body for substantially its entire length; and b) a base portion for use in mounting said shank portion in a tool for dispensing plastic fasteners.

2. The needle as claimed in claim 1 wherein said tip rapidly increases in diameter rearwardly from said blunt point to its full diameter.

3. The needle as claimed in claim 1 wherein said tip reaches full diameter at a distance of approximately 0.148 inches rearwardly of said blunt point.

4. The needle as claimed in claim 1 wherein said shank portion has a diameter of approximately 0.0693 inches.

5. The needle as claimed in claim 1 wherein the widest portion of said tip measured across opposing portions of said top edge is approximately 0.047 inches.

6. The needle as claimed in claim 1 wherein said tip has a length of 0.2252 inches.

7. A needle for use in a tool for dispensing plastic fasteners, the plastic fasteners each comprising an elongated filament and a cross-bar, the cross-bar being disposed at one end of the elongated filament, said needle comprising:

a) a shank portion, said shank portion having a cylindrical body terminating in a cone-shaped tip having a blunt point, wherein said tip reaches full diameter at a distance of approximately 0.148 inches rearwardly of said blunt point, said cylindrical body being provided with a longitudinal bore through which the cross-bar of a fastener may pass and a slot through which the elongated filament of a plastic fastener may extend, said slot extending longitudinally along said cylindrical body for substantially its entire length; and b) a base portion for use in mounting said shank portion in a tool for dispensing plastic fasteners.

8. A needle for use in a tool for dispensing plastic fasteners, the plastic fasteners each comprising an elongated filament and a cross-bar, the cross-bar being disposed at one end of the elongated filament, said needle comprising:

a) a shank portion, said shank portion having a cylindrical body terminating in a cone-shaped tip having a blunt point, said cone-shaped tip having a tip length and said shaft portion having a diameter and wherein the ratio of said tip length to said shaft diameter is approximately 3.2 to 1, said cylindrical body being provided with a longitudinal bore through which the cross-bar of a fastener may pass and a slot through which the elongated filament of a plastic fastener may extend, said slot extending longitudinally along said cylindrically body for substantially its entire length; and b) a base portion for use in mounting said shank portion in a tool for dispensing plastic fasteners.

* * * * *